US007784421B1

(12) United States Patent
Norton et al.

(10) Patent No.: US 7,784,421 B1
(45) Date of Patent: Aug. 31, 2010

(54) BOAT BOOTY SYSTEM

(76) Inventors: Robert C. Norton, 1815 8th Ave., SW., Largo, FL (US) 33770-3151; Karen Norton, 1815 8th Ave., SW., Largo, FL (US) 33770-3151

( * ) Notice: Subject to any disclaimer, the term of this patent is extended or adjusted under 35 U.S.C. 154(b) by 184 days.

(21) Appl. No.: 12/221,647

(22) Filed: Aug. 5, 2008

(51) Int. Cl.
*B63B 17/00* (2006.01)
*B63B 17/02* (2006.01)

(52) U.S. Cl. ..... 114/361; 114/343

(58) Field of Classification Search ..... 114/343, 114/361
See application file for complete search history.

(56) References Cited

U.S. PATENT DOCUMENTS 1,070,260 A * 8/1913 Jameson ..... 114/229
3,142,283 A * 7/1964 Fisher ..... 114/222
4,026,233 A * 5/1977 Cox ..... 114/229
4,092,943 A 6/1978 Lund
5,203,273 A * 4/1993 Sandlofer ..... 114/229
5,465,676 A 11/1995 Falcaro
7,047,900 B2 5/2006 Nelson
7,455,023 B2 * 11/2008 Gerstenberger ..... 114/221 R

* cited by examiner

*Primary Examiner*—Daniel V Venne

(57) ABSTRACT

A boat booty has a closed bottom and an open top for the removable receipt of a boat hull. A rope encompasses the boat booty. Retaining strips secure the rope in operating position adjacent to the open top. A coupling assembly includes a plurality of lines. Each line has a fixed end coupled to the rope. Each line has a free end adapted to be releasably coupled to a cleat. An evacuation assembly includes a flexible tube. The flexible tube is coupled with respect to the boat booty. In this manner water is removed from the space between the boat and the boat booty while a user pulls on the lines to raise the upper edge of the boat booty.

4 Claims, 3 Drawing Sheets

FIG 1
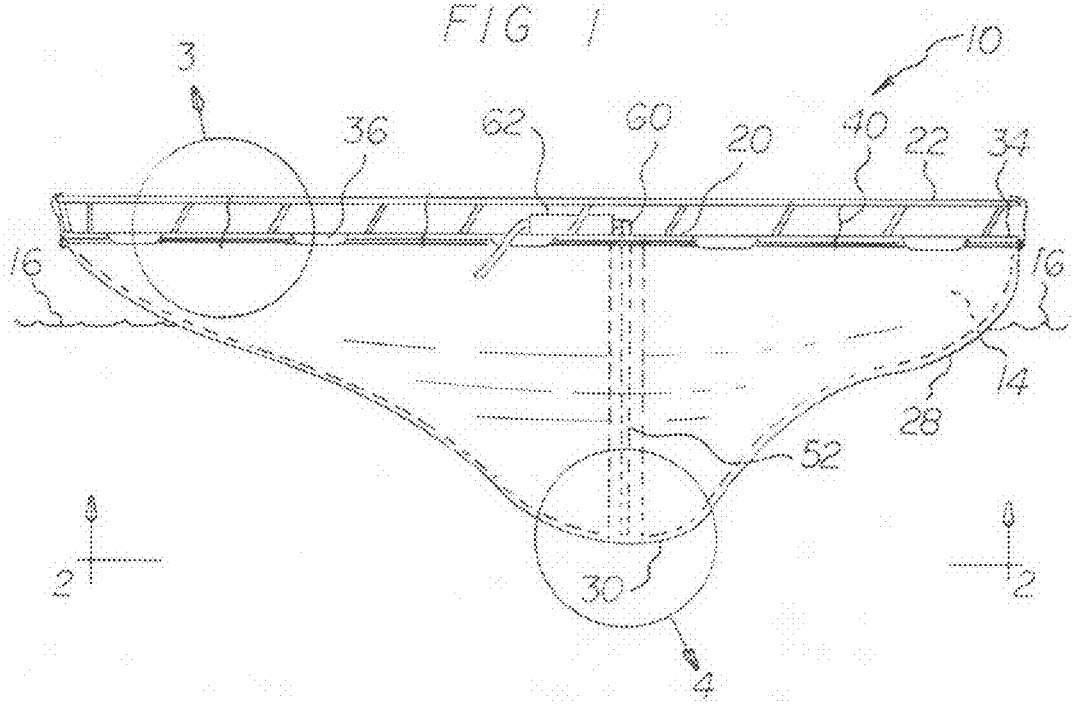
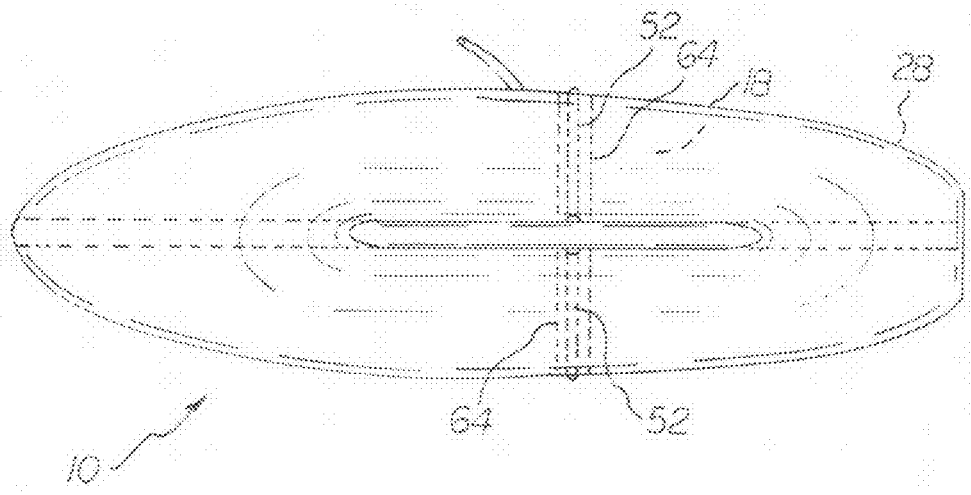
FIG 2

FIG 3
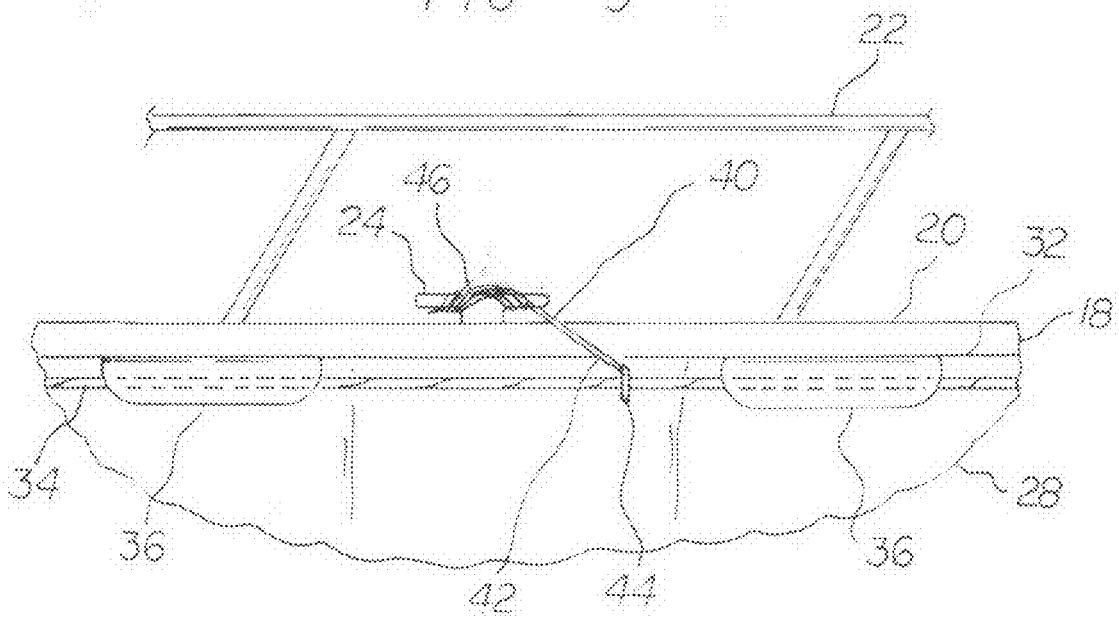
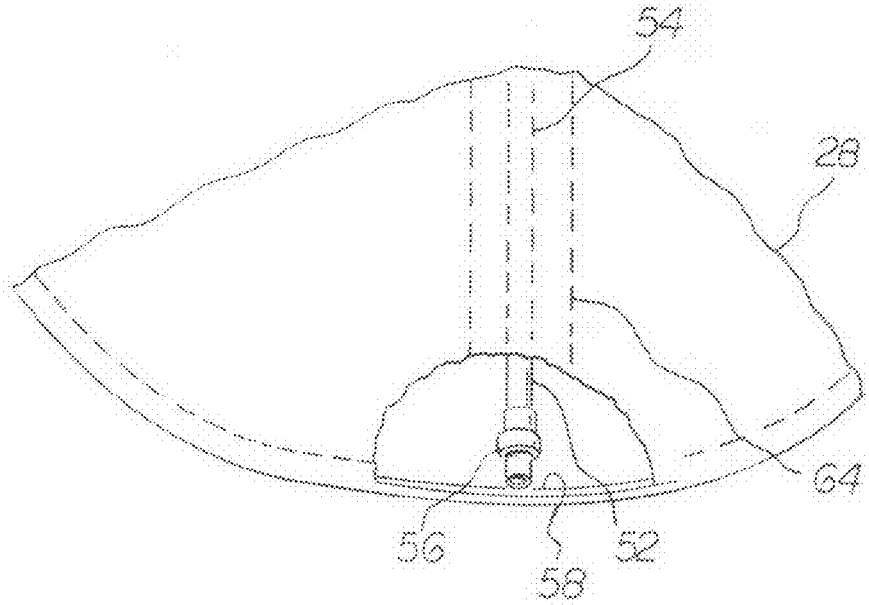
FIG 4

FIG 5
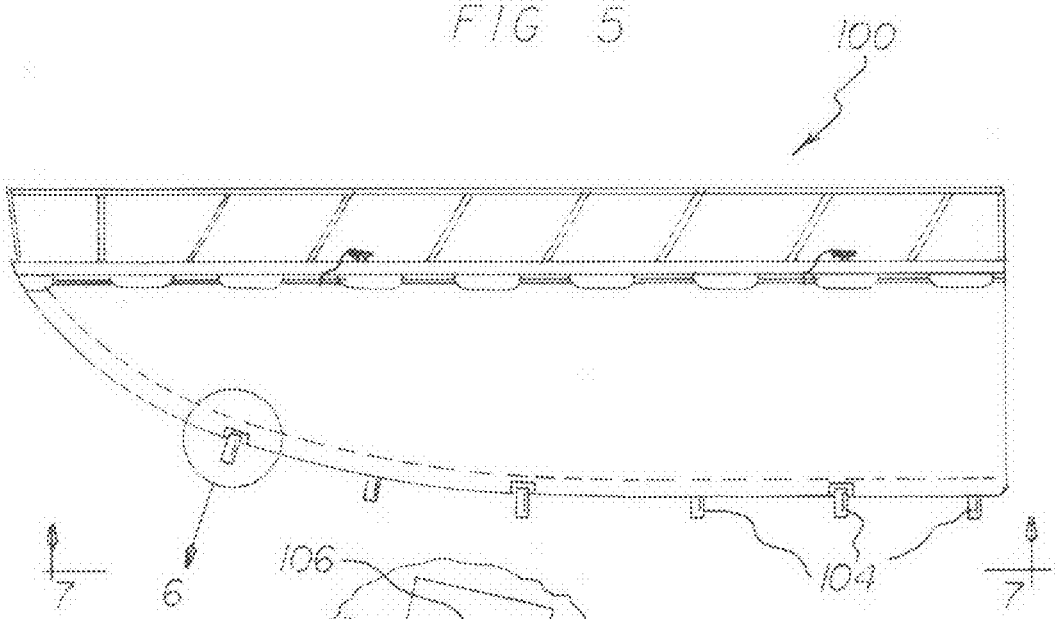
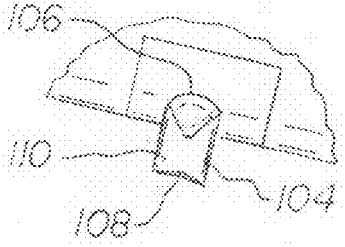
FIG 6
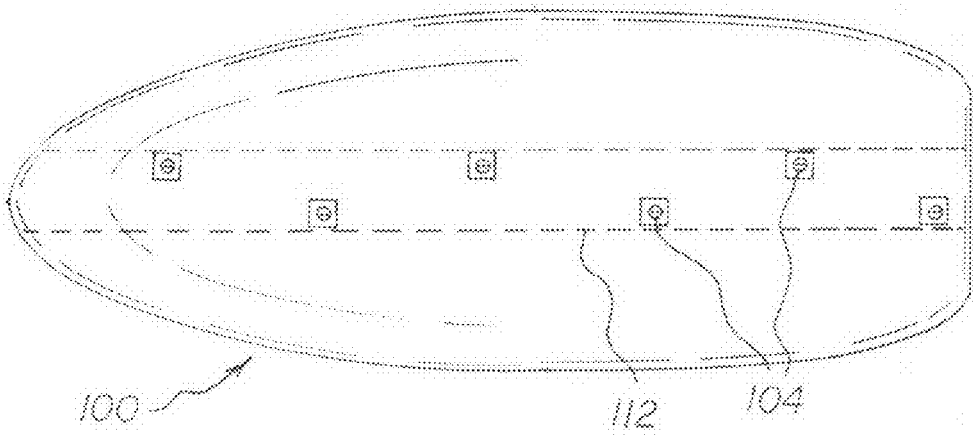
FIG 7

BOAT BOOTY SYSTEM

BACKGROUND OF THE INVENTION

1. Field of the Invention

The present invention relates to a boat booty system and more particularly pertains to covering a hull of a boat on the water with no water-to-boat contact in order to abate barnacle growth for decreasing maintenance and repair costs of the boat and for increasing operating efficiencies of the boat.

2. Description of the Prior Art

The use of boat storage systems of known designs and configurations is known in the prior art. More specifically, boat storage systems of known designs and configurations previously devised and utilized for the purpose of protecting a boat through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,092,943 issued Jun. 6, 1978 to Lund relates to a Marine Protection System. U.S. Pat. No. 5,465,676 issued Nov. 14, 1995 to Falcaro relates to a Barnacle Shield. U.S. Pat. No. 5,549,069 issued Aug. 27, 1996 to Faidi relates to an Enclosure for Shielding Moored Water Vessel Hull from Direct Contact with Water. Lastly, U.S. Pat. No. 7,047,900 issued May 21, 2006 to Nelson related to a Watercraft Storage Apparatus and Method.

While these devices fulfill their respective, particular objectives and requirements, the aforementioned patents do not describe a boat booty system that allows for covering a hull of a boat on the water with no water-to-boat contact in order to abate barnacle growth for decreasing maintenance and repair costs of the boat and for increasing operating efficiencies of the boat.

In this respect, the boat booty system according to the present invention substantially departs from the conventional concepts and designs of the prior art, and in doing so provides an apparatus primarily developed for the purpose of covering a hull of a boat on the water with no water-to-boat contact in order to abate barnacle growth for decreasing maintenance and repair costs of the boat and for increasing operating efficiencies of the boat.

Therefore, it can be appreciated that there exists a continuing need for a new and improved boat booty system which can be used for covering a hull of a boat on the water with no water-to-boat contact in order to abate barnacle growth for decreasing maintenance and repair costs of the boat and for increasing operating efficiencies of the boat. In this regard, the present invention substantially fulfills this need.

SUMMARY OF THE INVENTION

In view of the foregoing disadvantages inherent in the known types of boat storage systems of known designs and configurations now present in the prior art, the present invention provides an improved boat booty system. As such, the general purpose of the present invention, which will be described subsequently in greater detail, is to provide a new and improved boat booty system and method which has all the advantages of the prior art and none of the disadvantages.

To attain this, the present invention essentially comprises a boat booty system. First provided is a boat. A waterline is provided. The boat is positionable on the water at the waterline. The boat has a hull. The hull is provided below the waterline. The boat has a deck. The deck is provided principally above the waterline. The hull has a configuration to facilitate sailing characteristics. The deck has an upstanding peripheral rail. The upstanding peripheral rail is provided at a first elevation above the deck. The deck has a plurality of cleats. The cleats are provided at a second elevation. The second elevation is less than the first elevation above the waterline.

A boat booty is provided. The boat booty has a configuration essentially corresponding to the configuration of the boat hull. The boat booty has a closed bottom. The boat booty has an open top. The open top removably receives the boat hull. A rope is provided. The rope encompasses the boat booty on the face of the boat booty remote from the boat. Retaining strips are provided. The retaining strips secure the rope in operating position adjacent to the open top during operation and use. The rope is adapted to assist a user in pulling the boat booty onto the hull of the boat from a first end of the boat to a second end of the boat. The rope is further adapted for pulling the boat booty from the hull of the boat from a second end of the boat to a first end of the boat. The boat booty is fabricated of a flexible, water impervious material. The flexible, water impervious material is selected from the class of flexible, water impervious materials. The class of flexible, water impervious materials includes plastic and rubber, natural and synthetic, and blends thereof.

Further provided is a coupling assembly. The coupling assembly secures the boat booty to the boat. The coupling assembly includes a plurality of lines. Each line has a fixed end. The fixed end has a ring. The rope extends through the rings. Each line has a free end. The free end is adapted to be releasably coupled to an associated cleat. The lines are adapted to be pulled upwardly by a user. In this manner the open end of the boat booty is raised. Further in this manner assistance is provided in squeezing water from the space between the boat booty and the hull of the boat.

Provided last is an evacuation assembly. The evacuation assembly includes a flexible tube. The flexible tube is provided along each side of the boat booty. The tubes have a central extent. The central extent is located between the hull of the boat and the boat booty. The tubes each have a lower end with a one-way valve. The boat booty has a lowermost extent. The lower end is provided adjacent to the lowermost extent of the boat booty. The lower end of each tube is at a location most remote from the upper edge. The tubes have an upper end. The upper end is provided above the upper edge of the boat booty. The evacuation assembly includes a pump. The pump is coupled to the upper end of each tube. The evacuation assembly includes a strengthening strip. The strengthening strip is secures each tube to the boat booty from the upper end to the lower end. The pump is adapted to remove the water from the space between the boat and the boat booty while a user pulls on the lines to raise the upper edge of the boat booty.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boat booty system which has all of the advantages of the prior art boat storage systems of known designs and configurations and none of the disadvantages.

It is another object of the present invention to provide a new and improved boat booty system which may be easily and efficiently manufactured and marketed.

It is further object of the present invention to provide a new and improved boat booty system which is of durable and reliable constructions.

An even further object of the present invention is to provide a new and improved boat booty system which is susceptible of a low cost of manufacture with regard to both materials and labor, and which accordingly is then susceptible of low prices of sale to the consuming public, thereby making such boat booty system economically available to the buying public.

Even still another object of the present invention is to provide a boat booty system for covering a hull of a boat on the water with no water-to-boat contact in order to abate barnacle growth for decreasing maintenance and repair costs of the boat and for increasing operating efficiencies of the boat.

Lastly, it is an object of the present invention to provide a new and improved boat booty system. A boat booty has a closed bottom and an open top for the removable receipt of a boat hull. A rope encompasses the boat booty. Retaining strips secure the rope in operating position adjacent to the open top. A coupling assembly includes a plurality of lines. Each line has a fixed end coupled to the rope. Each line has a free end adapted to be releasably coupled to a cleat. An evacuation assembly includes a flexible tube. The flexible tube is coupled with respect to the boat booty. In this manner water is removed from the space between the boat and the boat booty while a user pulls on the lines to raise the upper edge of the boat booty.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a boat booty system constructed in accordance with the principles of the present invention.

FIG. 2 is a bottom view of the system taken along line 2-2 of FIG. 1.

FIG. 3 is an enlarged side elevational view of a portion of the system taken at Circle 3 of FIG. 1.

FIG. 4 is an enlarged side elevational view of a portion of the system taken at Circle 4 of FIG. 1.

FIG. 5 is a side elevational view of a boat booty system constructed in accordance with an alternate embodiment of the invention.

FIG. 6 is an enlarged side elevational view of a portion of the system taken at Circle 6 of FIG. 5.

FIG. 7 is a bottom view of the system taken along line 7-7 of FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved boat booty system embodying the principles and concepts of the present invention and generally designated by the reference numeral 10 will be described.

The present invention, the boat booty system 10 is comprised of a plurality of components. Such components in their broadest context include a boat booty, a coupling assembly and an evacuation assembly. Such components are individually configured and correlated with respect to each other so as to attain the desired objective.

First provided is a boat 14. A waterline 16 is provided. The boat is positionable on the water at the waterline. The boat has a hull 18. The hull is provided below the waterline. The boat has a deck 20. The deck is provided principally above the waterline. The hull has a configuration to facilitate sailing characteristics. The deck has an upstanding peripheral rail 22. The upstanding peripheral rail is provided at a first elevation above the deck. The deck has a plurality of cleats 24. The cleats are provided at a second elevation. The second elevation is less than the first elevation above the waterline.

A boat booty 28 is provided. The boat booty has a configuration essentially corresponding to the configuration of the boat hull. The boat booty has a closed bottom 30. The boat booty has an open top 32. The open top removably receives the boat hull. A rope 34 is provided. The rope encompasses the boat booty on the face of the boat booty remote from the boat. Retaining strips 36 are provided. The retaining strips secure the rope in operating position adjacent to the open top during operation and use. The rope is adapted to assist a user in pulling the boat booty onto the hull of the boat from a first end of the boat to a second end of the boat. The rope is further adapted for pulling the boat booty from the hull of the boat from a second end of the boat to a first end of the boat. The boat booty is fabricated of a flexible, water impervious material. The flexible, water impervious material is selected from the class of flexible, water impervious materials. The class of flexible, water impervious materials includes plastic and rubber, natural and synthetic, and blends thereof.

Further provided is a coupling assembly. The coupling assembly secures the boat booty to the boat. The coupling assembly includes a plurality of lines 40. Each line has a fixed end 42. The fixed end has a ring 44. The rope extends through the rings. Each line has a free end 46. The free end is adapted to be releasably coupled to an associated cleat. The lines are adapted to be pulled upwardly by a user. In this manner the open end of the boat booty is raised. Further in this manner assistance is provided in squeezing water from the space between the boat booty and the hull of the boat.

Provided last is an evacuation assembly. The evacuation assembly includes a flexible tube 52. The flexible tube is provided along each side of the boat booty. The tubes have a central extent 54. The central extent is located between the hull of the boat and the boat booty. The tubes each have a lower end with a one-way valve 56. The preferred one-way valve is a plastic in-line non-return valve, Model LV1219, sold by Munster Simms Engineering Ltd. of Bangor, N. Ireland. The boat booty has a lowermost extent 58. The lower end is provided adjacent to the lowermost extent of the boat booty. The lower end of each tube is at a location most remote from the upper edge. The tubes have an upper end 60. The upper end is provided above the upper edge of the boat booty. The evacuation assembly includes a pump 62. The pump is coupled to the upper end of each tube. The evacuation assembly includes a strengthening strip 64. The strengthening strip is secures each tube to the boat booty from the upper end to the lower end. The pump is adapted to remove the water from the space between the boat and the boat booty while a user pulls on the lines to raise the upper edge of the boat booty.

In an alternate embodiment of the present invention, the flexible tube is a plurality of similarly configured flapper valves 104. The flapper valves are located along the bottom the boat booty. Each flapper valve has an upper end 106. The upper end is coupled to the bottom of the boat booty. Each flapper valve has a lower end 108. The lower end is provided beneath the boat booty. The flapper valve constitutes a one-way valve 110. The preferred one-way valve is a Marine Duckbill Scupper, Model DBS2B-DB, sold by T-H Marine Inc. of Huntsville, Ala. In this manner water is precluded from entering the space between the boat booty and a boat. Further in this manner the flow of water from the space between the boat booty and a boat is facilitated while a user pulls on the lines to raise the upper edge of the boat booty. The boat booty has a strengthening strip 112. The strengthening strip is provided along the length of the boat booty adjacent to the lower extent thereof.

Barnacles can cause a person physical harm and damage when they adhere to an owner's boat. The hard, sharp shells of barnacles will cut a person, causing pain and infection. Moreover, barnacles will greatly reduce performance and efficiency when attached to one's boat. The present invention is to prohibit and greatly retard the growth of barnacles on boat hulls, without the use of toxic coatings, or, without lifting the boat out of the water into storage. The premise of the boat booty is to keep the boat, "ON the water"; not, "IN the water."

The purpose of the boat booty is to keep larvae barnacles from attaching to the hull of a boat by keeping the juvenile barnacles from coming in contact with the hull. The present invention accomplishes this by wrapping the boat hull and its mechanical parts in an impervious material. This material must be cut, sewn and sealed into the appropriate shape of the hull that is to be fitted to the boat. Then, as much of the salt water as possible must be removed, by one of two methods. This would actually be removing the boat from contact with the barnacle bearing water, without lifting the boat out of the water or dry storing the boat. The advantage of the boat booty is that the water is still supporting the boat, but the boat is "out of the water."

The cost of petroleum fuel continues to rise. A boat with barnacle growth will use more fuel to achieve a plane, thus increasing drag; which uses more fuel. Conversely, a boat with virtually no barnacles allows for faster travel for the boat owner, using fewer gallons of gas per hour for the same distance traveled. The boat booty will eliminate damage to the metal drive components, the corrosion and the pitting of the metal. The additional application of nontoxic grease(s) will virtually eliminate, or at least extend the useful life of a boat's rubber parts, propellers and out drives. Barnacles naturally accumulate on boat water intakes which causes over heating in engines and therefore, expensive repairs.

The boat booty will primarily be used to protect boats too large to be removed from the water. The boat booty will provide boat owners with floating docks, protection of their own boat without the expense of hiring a maintenance crew to scrape barnacles from the boat bottom and the expense of painting the boat bottom as often. This eliminates the need for davits at private docks. The boat booty will appeal to boat owners' who expect the same performance from their boat from the day they purchased it and even one, two or five years later. The boat booty will be ideal for boat owners who spend less time on their boat and want less maintenance. This group uses their boat infrequently or possibly, shares the use of a boat, i.e., those that store boats at marinas in the Caribbean, sail in competitions, etc. The operator who expects maximum performance can simply remove the Boat Booty, and take off on their boat without worry.

The boat booty will maintain the efficiency of a sailboat, allowing the hull to maintain the shape and the design for which the sailboat was engineered. Serious sailors, who demand performance from their boat, can use the boat booty to maintain their own boat, without having their boat hauled, scraped, sanded and repainted. The boat booty will protect the integrity of the boat's original jell-coat finish. Antifouling paints have a higher coefficient of friction, increasing drag, which will not allow boats to perform as designed.

The design of the boat booty has to be a custom fit for each model and manufacturer to provide a proper fit for each boat and minimize material used. However, there is a strong possibility to market generic boat booty's for certain power boats that have similar size hulls, considering boats' similar width and length. Sailboats will most likely have to have custom boat booty's to provide for their specific length and placement and the size of their keels. Each boat booty design will be custom for each craft. This will minimize the material used to make the boat booty, which allows for the ease of the handling of it along with the installation of the boat booty. The easier it is to put the boat booty on the boat, take off the boat and to store, the more desirable the boat booty will be to a boat operator. If there is ease in putting the boat booty on, an owner is more apt to use it, therefore, protecting the boat. The objective is to make the boat booty as easy to slip on the boat hull, as it is to put on a topside cover that protects against weather and sun damage.

The design of the boat booty should take into account the type of mechanical propulsion, i.e., inboard, inboard-outboard or outboard motor. The boat booty can be designed to accommodate the boat's shape, the length and beam, propellers, cutters, out drives and special accessories to the boat. In addition, reinforced material will be used for areas of stress where extra strength may be needed. Reinforced material will be added along the keel or centerline of the boat.

The boat booty is custom fit to the shape of the sailboat's specific hull. Reinforced material will be added along the keel and for areas of stress where extra strength may be needed. The mission of the boat booty is to minimize maintenance and the associated costs, while maximizing the boats' protection from natural occurring marine organisms.

By removing water inside the boat booty, natural occurring pressure will give a tight fit to the hull. Onboard bilge pumps or a separate booty pump kit will practically eliminate water coming in contact with the boat hull. A hose can be slipped inside the boat booty after it is fastened to cleats or rails. Then pumping is activated. As water is pumped out of the boat booty, adjustment of the ropes can take place to achieve the tight fit of the booty that is desired. Shallow draft hulls and power boats can virtually be pumped dry by placing the hose into the lowest areas toward the bottom center of the boat. Deep draft hulls and/or sailboats will develop a pocket of water centering around the lowest point, the keel, which is where the bilge connection has to reach. This reach can best be attained by the placement of a hollow sleeve, one on each side, sewn or sealed into the Boat Booty to allow a passage way to direct the hose toward the lowest point, keel, on the sailboat. The boat booty has to be shaped large enough to slip under the hull full of water, but not too large to be neatly tied up and tightened to the boat, as water is eliminated.

Flapper check valves can be heat sealed onto the lowest points along the centerline of the boat booty. The use of weight from the water and the natural pressure adjustment will remove unwanted water. As pressure is extended on the water inside the boat booty by tightening the supporting ropes, water will be pushed through the check valves. This method eliminates the need for pumps and hose, therefore, best suited for shallow draft crafts where greater inside pressure will develop with the pulling and tightening of the fastening ropes. The check valves are synthetic rubber construction that will have a 2 inch diameter sealing base to allow for reinforcement of material around the base for added strength. Attachment to the boat booty is accomplished through heat sealing to provide a watertight bond.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat booty system comprising:

a boat booty with a closed bottom and an open top for the removable receipt of a boat hull, a rope encompassing the boat booty with retaining strips securing the rope in operating position adjacent to the open top;

a coupling assembly including a plurality of lines, each line having a fixed end coupled to the rope and a free end adapted to be releasably coupled to a cleat; and an evacuation assembly including a flexible tube coupled to the boat booty to remove the water from the space between the boat and the boat booty while a user pulls on the lines to raise the upper edge of the boat booty.

2. The system as set forth in claim 1 wherein the tube has a lower end adjacent to a lowermost extent of the boat booty, the lower end of the tube being at a location most remote from the upper edge, the tube having an upper end above the upper edge of the boat booty with a pump coupled to the upper end of the tube, the pump adapted to removing the water from the space between the boat and the boat booty while a user pulls on the lines to raise the upper edge of the boat booty.

3. The system as set forth in claim 1 wherein the flexible tube is a plurality of flapper valves located along the bottom the boat booty, each flapper valve having an upper end coupled to the bottom of the boat booty, each flapper valve having a lower end beneath the boat booty, the flapper valve operating as a one-way valve to preclude water from entering the a space between the boat booty and a boat and to facilitate the flow of water from the space between the boat booty and a boat while a user pulls on the lines to raise the upper edge of the boat booty, the boat booty having a strengthening strip along the length of the boat booty adjacent to the lower extent thereof.

4. A boat booty system for covering a hull of a boat on the water with no water-to-boat contact in order to abate barnacle growth comprising, in combination:

a boat positionable on the water at a waterline, the boat having a hull below the waterline and a deck principally above the waterline, the deck having an upstanding peripheral rail at a first elevation above the deck and a plurality of cleats at a second elevation less than the first elevation above the waterline;

a boat booty with a closed bottom and an open top for the removable receipt of the boat hull, a rope encompassing the boat booty on a face of the boat booty remote from the boat with retaining strips securing the rope in operating position adjacent to the open top, the rope adapted to assist a user in pulling the boat booty onto the hull of the boat from a first end of the boat to a second end of the boat and for pulling the boat booty from the hull of the boat from a second end of the boat to a first end of the boat, the boat booty being fabricated of a flexible, water impervious material;

a coupling assembly for securing the boat booty to the boat, the coupling assembly including a plurality of lines, each line having a fixed end with a ring, the rope extending through the rings, each line having a free end adapted to be releasably coupled to an associated cleat, the lines adapted to be pulled upwardly by a user to raise the open end of the boat booty for assisting in squeezing water from a space between the boat booty and the hull of the boat; and an evacuation assembly including a flexible tube along each side of the boat booty, the tubes having a central extent located between the hull of the boat and the boat booty, the tubes each having a lower end with a one-way valve adjacent to a lowermost extent of the boat booty, the lower end of each tube being at a location most remote from the upper edge, the tubes having an upper end above the upper edge of the boat booty with a pump coupled to the upper end of each tube, a strengthening strip securing each tube to the boat booty from the upper end to the lower end, the pump adapted to removing the water from the space between the boat and the boat booty while a user pulls on the lines to raise the upper edge of the boat booty.

* * * * *